US005671854A

United States Patent [19]

Thomas

[11] Patent Number: 5,671,854

[45] Date of Patent: Sep. 30, 1997

[54] CONTAINER FRAME ASSEMBLY

[75] Inventor: Lloyd Gene Thomas, Perrysburg, Ohio

[73] Assignee: Great Lakes Standard Manufacturing, Inc., Toledo, Ohio

[21] Appl. No.: 592,035

[22] Filed: Jan. 26, 1996

[51] Int. Cl.[6] ..... B65D 88/12

[52] U.S. Cl. ..... 220/1.5; 220/668; 220/625

[58] Field of Search ..... 220/1.5, 668, 4.28, 220/400, 625; 217/65, 36

[56] References Cited

U.S. PATENT DOCUMENTS

| | | | |
|---|---|---|---|
| 2,486,709 | 11/1949 | Friday et al. . | |
| 2,700,457 | 1/1955 | Munroe . | |
| 3,209,905 | 10/1965 | Kean . | |
| 3,294,276 | 12/1966 | Kemp et al. | 220/668 |
| 3,315,639 | 4/1967 | Close | 217/65 |
| 4,998,636 | 3/1991 | Hardigg | 220/668 |
| 5,137,165 | 8/1992 | Friman . | |
| 5,178,292 | 1/1993 | Korzeniowski | 220/668 |
| 5,345,879 | 9/1994 | Maillard . | |
| 5,386,919 | 2/1995 | Long . | |
| 5,413,224 | 5/1995 | Marron et al. | 220/1.5 |

FOREIGN PATENT DOCUMENTS

| | | | |
|---|---|---|---|
| 2026985 | 2/1980 | United Kingdom | 220/668 |

*Primary Examiner*—Stephen J. Castellano
*Attorney, Agent, or Firm*—Emch, Schaffer, Schaub & Porcello Co., L.P.A.

[57] ABSTRACT

A container frame assembly is disclosed. The container frame assembly is positioned on a base which supports the item to be shipped. The assembly includes base gussets attached to the base. The gussets have sockets which receive vertical members, preferably constructed of formed sheet metal. Upper corner gussets receive the upper ends of the cross members. End members and rail members are also received in sockets of the upper corner gussets. A plurality of cross members have ends which receive the opposed rail members. A container shell or covering is placed adjacent the container frame assembly.

6 Claims, 7 Drawing Sheets

CONTAINER FRAME ASSEMBLY

BACKGROUND OF THE INVENTION

The present invention is directed to a carton or container system and more particularly to a container frame assembly which is used with a container shell or container covering, such as a cardboard box.

It is well known to place a item to be shipped, such as a lawn mower, on a platform or base and then to surround the item with a container shell, such as a cardboard carton. It has also been known to add additional reinforcing either on the interior or exterior of the carton to prevent the cartons collapse and damage to the item being shipped.

There are many disadvantages to prior art container reinforcing assemblies. These include the necessity to construct from wood or other materials, individual frames. It is also becoming more important to dispose of such reinforced containers after shipment, both in the United States and in Europe. When wood frames are used, disposing of the container assembly is often difficult.

The primary object of the present invention is to provide an improved container frame assembly which adequately protects items to be shipped, both during storage and shipping and which also may be reused. The components are easily disposable or recyclable.

The container frame assembly of the present invention is used with a base and with a container shell, such as a cardboard carton. The container frame assembly has a plurality of vertical frame members for attachment to the base. Corner gusset members are provided for receiving selected ones of the vertical members. At least two longitudinal rail members extend between ones of the vertical members and a plurality of cross-members extend between adjacent ones of the rail members. The container shell, such as a cardboard carton, is positioned adjacent the completed container frame assembly surrounding the item to be shipped, which is positioned on the base.

DETAILED DESCRIPTION OF THE PREFERRED EMBODIMENT

Figure 1:
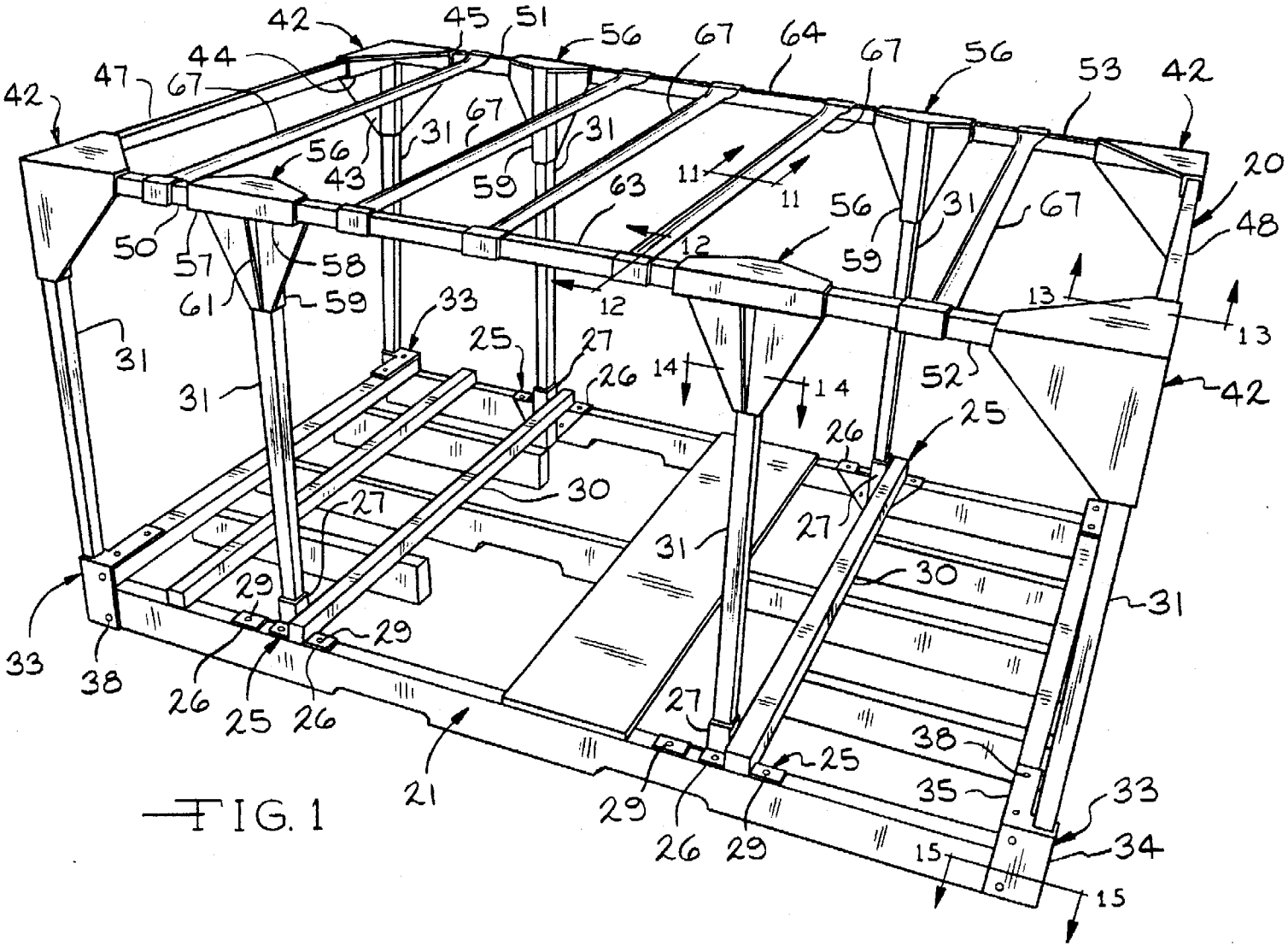
FIG. 1 is a perspective view of a container frame assembly, according to the present invention, mounted on a base.
Figure 2:
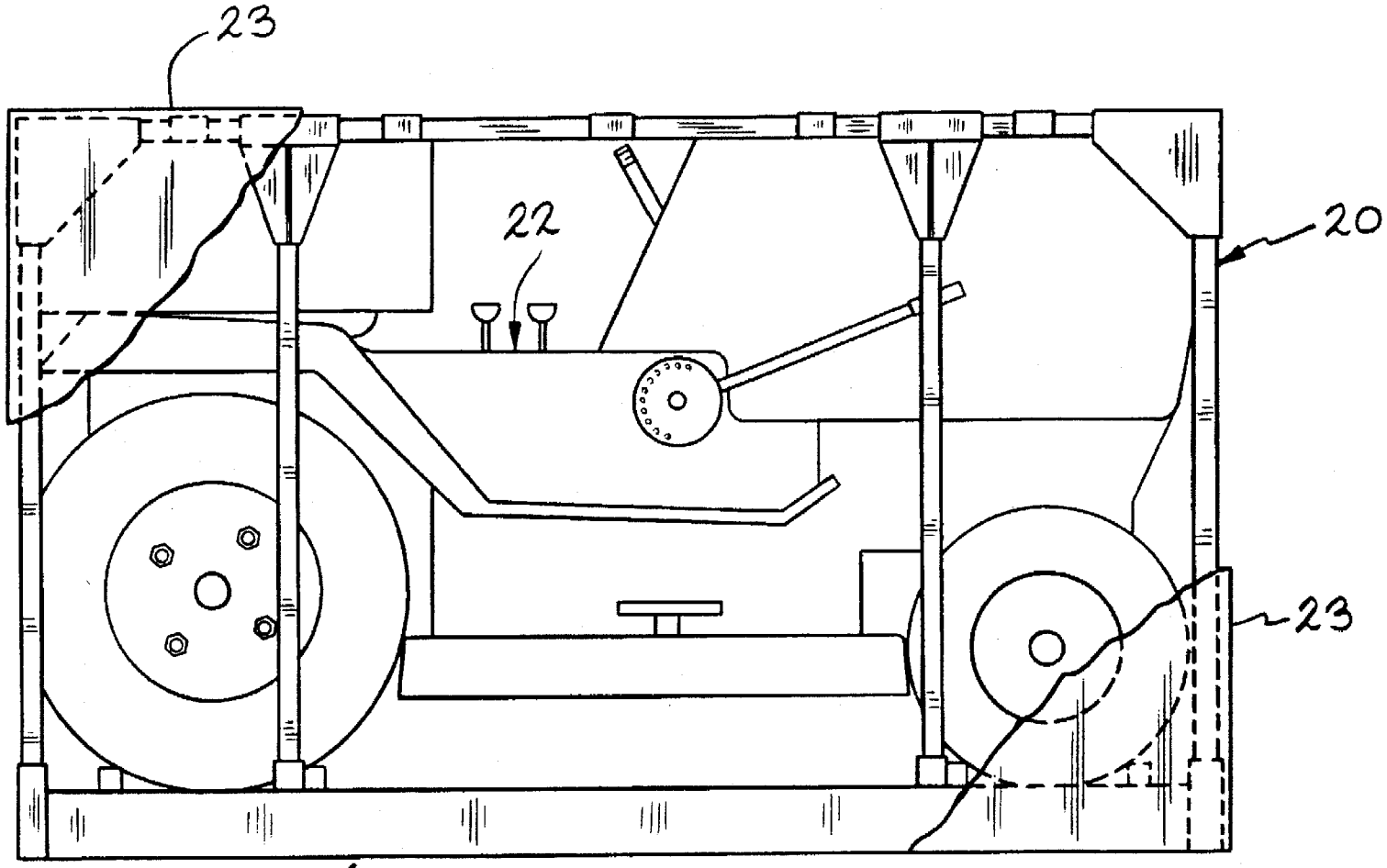
FIG. 2 is an elevational view of a container frame assembly, as shown in FIG. 1, with a lawn mower positioned on the base and indicating by dashed lines a surrounding container shell.

A container frame assembly, according to the present invention, is generally indicated by the reference number 20 in FIG. 1. The container frame assembly 20 is mounted on a rectangular base 21. The base 21 is normally constructed of wood and its components vary depending on the item to be shipped. In the present embodiment, the base 20 is designed to accommodate a riding lawn mower 22, as shown in FIG. 2. The container frame assembly 20 surrounds the mower 22. A container shell, for example, a cardboard carton 23 is positioned adjacent the container frame assembly 20 in surrounding relationship to the riding lawn mower 22. Container shells may be utilized other than cardboard containers. For examples, a relatively rigid plastic container may be utilized; paper composites may be utilized and various plastic films may be utilized.

The container frame assembly 20 includes a plurality of gusset members. While these members are preferably constructed from molded plastic materials, such as polypropylene, they can be made of metal or other plastics.

Figure 9:
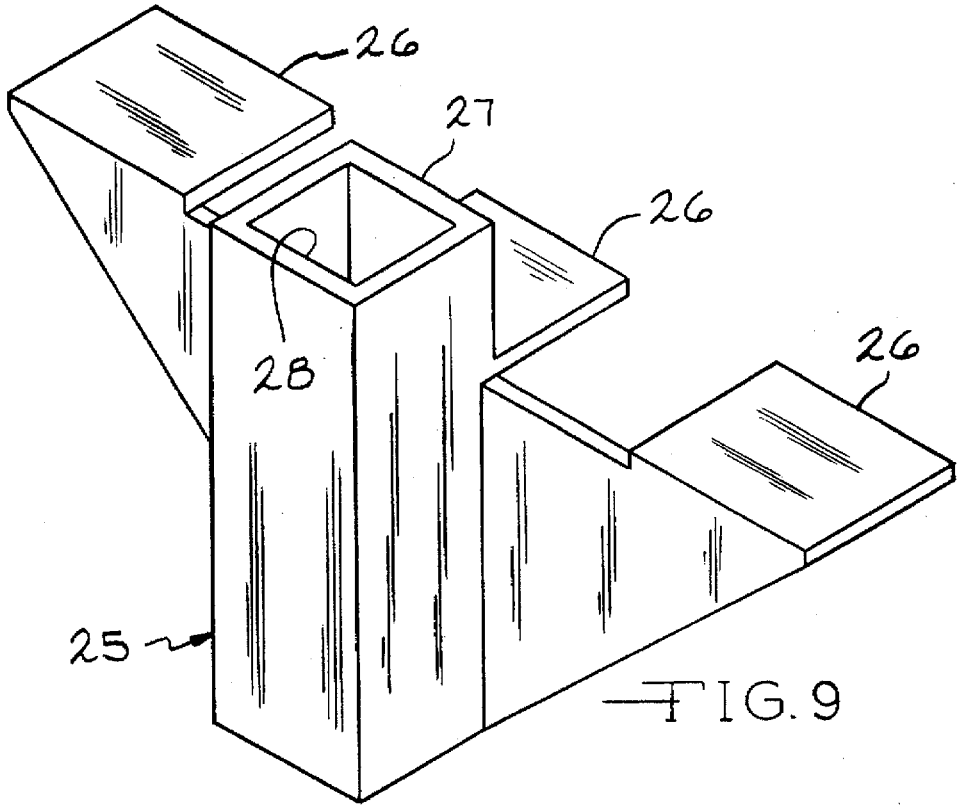
FIG. 9 is a front perspective view of a base gusset, according to the present invention.
Figure 10:
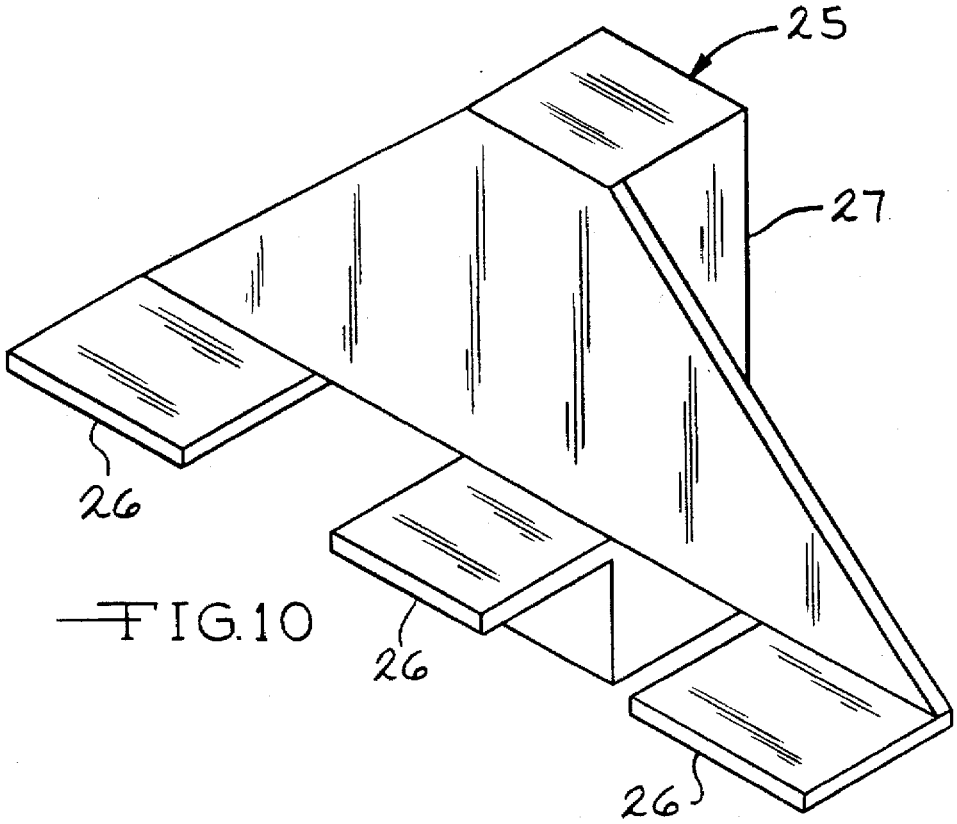
FIG. 10 is a rear perspective view of the base gusset shown in FIG. 9.

Referring to FIGS. 1, 9 and 10, a plurality of base gussets 25 include spaced mounting plates 26 and a vertically disposed socket 27 having a receiving opening 28. The mounting plates 26 are attached by fasteners 29 to the base 21. In the present embodiment, wooden base frame members 30 extend between spaced ones of the base gussets 25 and are positioned between adjacent ones of the mounting plates 26. The container frame assembly 20 also includes a plurality of vertical members 31 having their lower ends received in the openings 28 defined by the sockets 27 of the base gussets 25.

Figure 5:
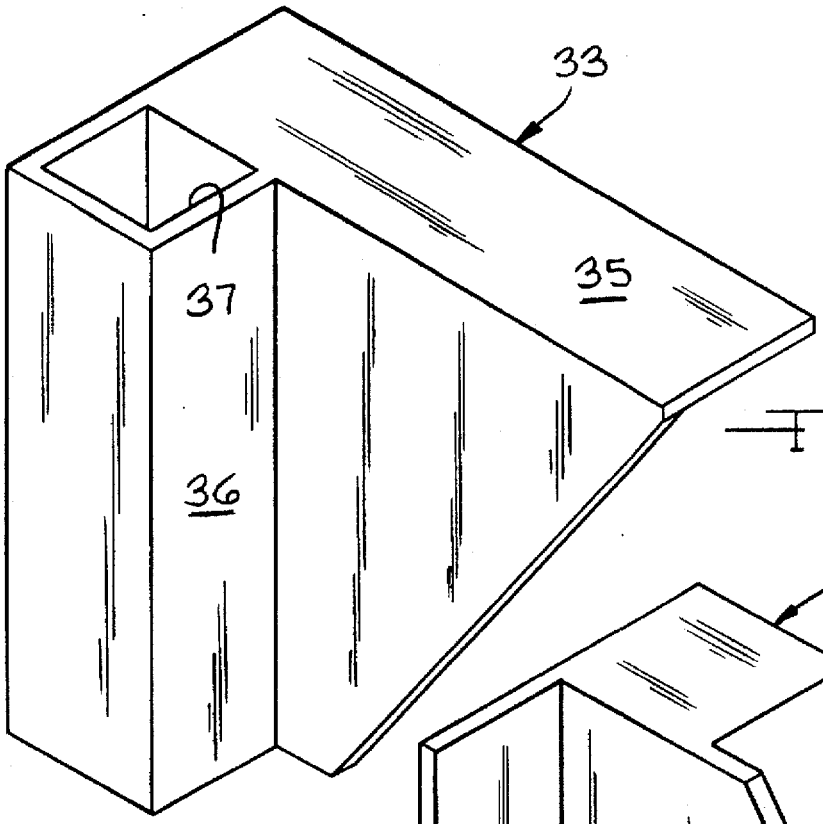
FIG. 5 is a front perspective view of a base corner member, according to the present invention.
Figure 6:
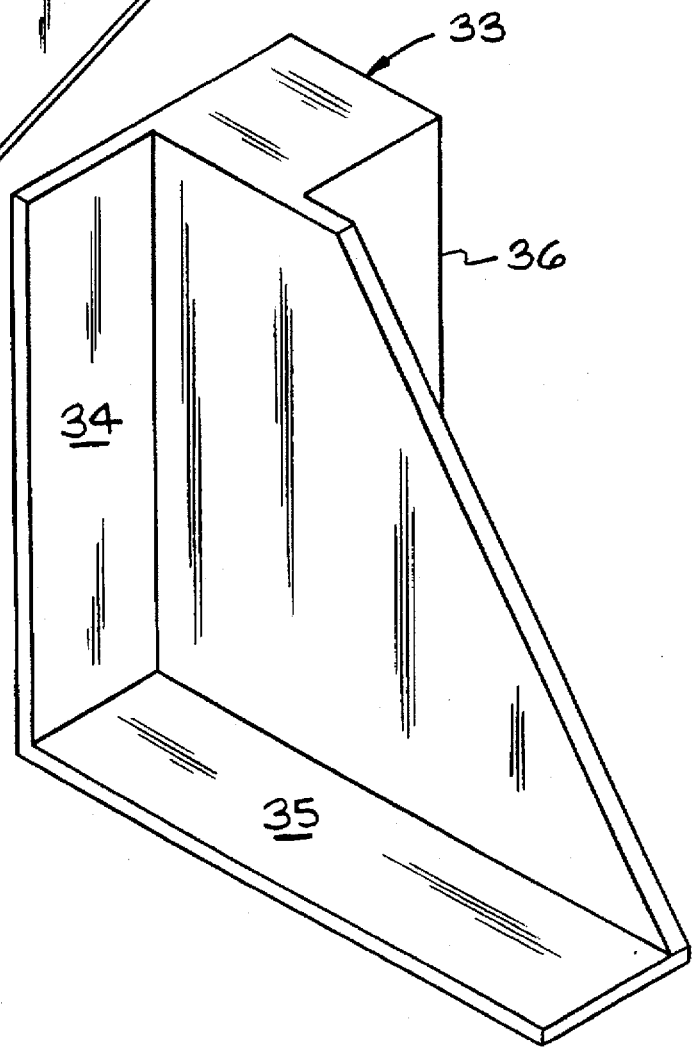
FIG. 6 is a rear perspective view of the base corner member shown in FIG. 5.

Referring to FIGS. 1,5 and 6, base corner gussets 33 are mounted at the four corners of the base 21. Each of the base corner gussets includes mounting flanges 34 and 35 and a socket 36 having a receiving opening 37. The mounting flanges 34 and 35 of the base corner gusset 33 are attached to the base 21 by fasteners 38. Additional ones of the vertical members 31 are positioned within the receiving openings 37 of the base corner gussets 33. While the vertical members 31 may be constructed of extruded plastics or other materials, the preferable material is a formed sheet metal.

Figure 15:
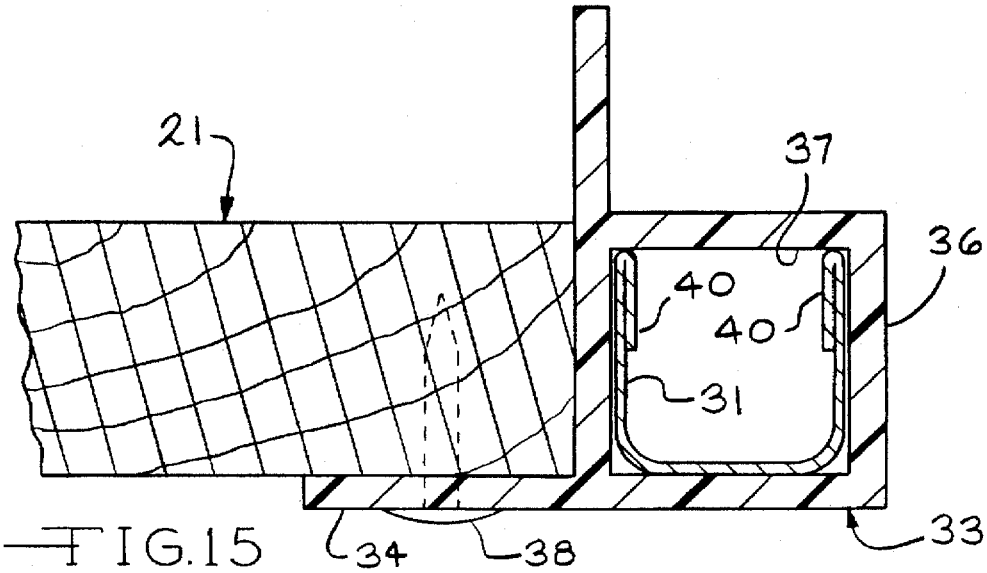
FIG. 15 is a cross-sectional view taken along the line 15—15 of FIG. 1 and shown on an enlarged scale.

Referring to FIG. 15, the vertical member 31 has a generally U-shaped cross-section with inturned edges 40.

Figure 3:
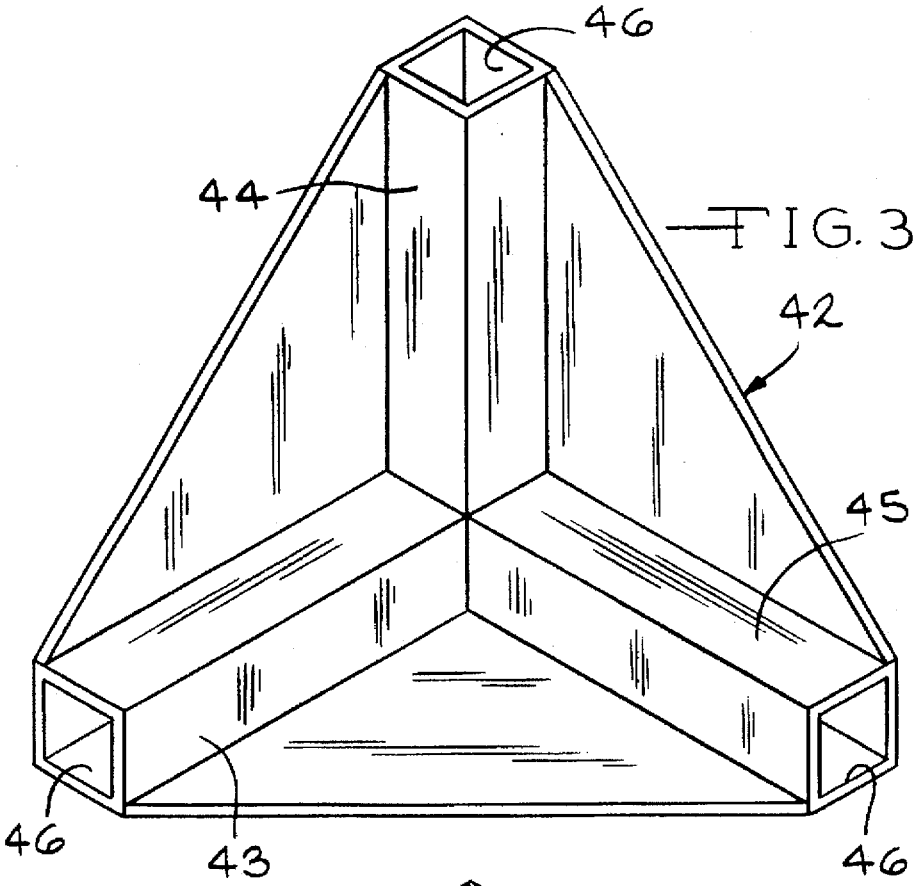
FIG. 3 is a front perspective view of a corner gusset, according to the present invention.
Figure 4:
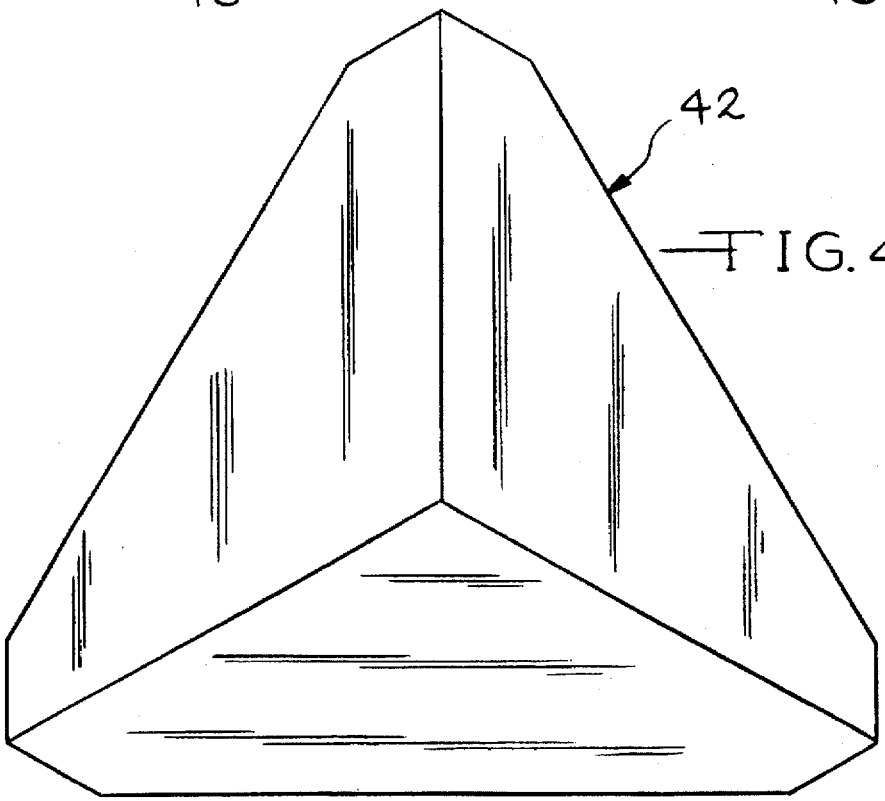
FIG. 4 is a rear perspective view of the corner gusset shown in FIG. 3.

Referring to FIGS. 1, 3 and 4, a plurality of upper corner gussets 42 are located at the upper ends of the four vertical members 31 which form the four corners of the overall container frame assembly 20. The upper corner gussets include sockets 43, 44 and 45 having receiving openings 46. The sockets 43, 44 and 45 are perpendicular to one another. Aligned ones of the sockets 43, 44 and 45 receive upper end members 47 and 48. The upper sockets also receive respective ones of opposed longitudinal rail members 50, 51, 52 and 53.

Figure 7:
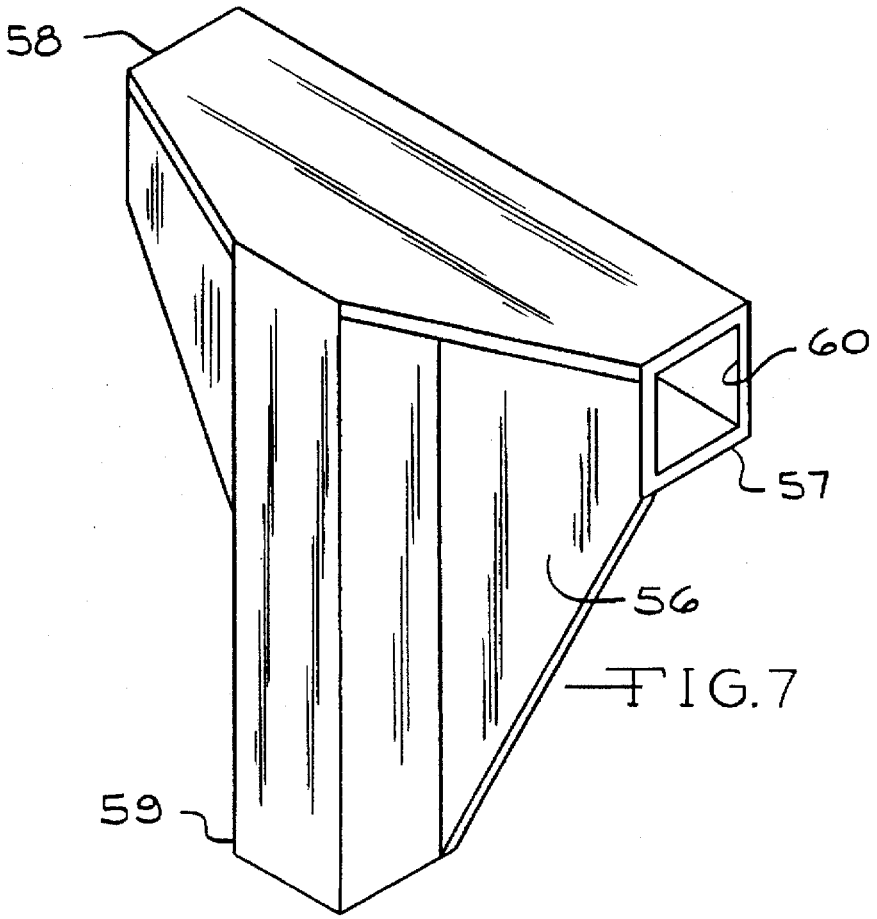
FIG. 7 is a front perspective view of a center gusset, according to the present invention.
Figure 8:
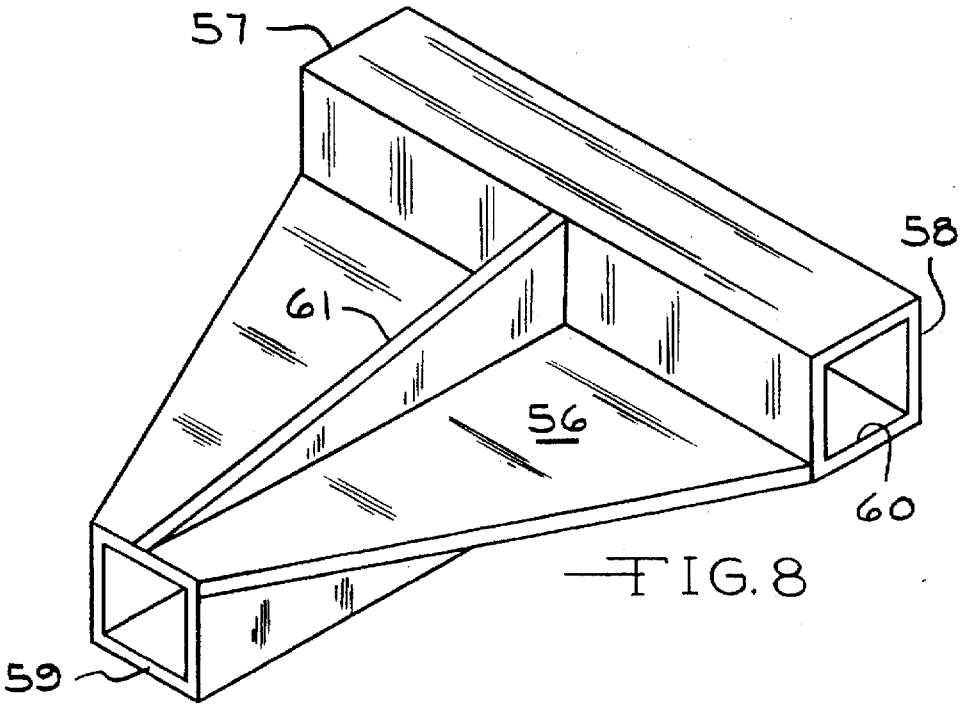
FIG. 8 is a rear perspective view of the center gusset shown in FIG. 7.

Referring to FIGS. 1, 7 and 8, the other ends of the longitudinal rail members 50, 51, 52 and 53 are received by upper center gussets 56. Each of the center gussets include aligned or parallel sockets 57 and 58 together with a perpendicular socket 59. Each of the sockets 57, 58 and 59 include a receiving opening 60. A reinforcing web 61 extends from the sockets 57 and 58 downwardly along the socket 59. The sockets 59 receive the upper ends of the intermediate ones of the vertical members 31. Opposed upper longitudinally extending rail members 63 and 64 are aligned with the rail members 50, 51, 52 and 53 and are received by the sockets of the upper center gussets 56. A plurality of cross-members 67 having ends 68 extend between the opposed and parallel ones of the aligned rail members 50–53 and 63–64. The ends 68 of the cross-member 67 are positioned over the rail members, for example the rail member 63 shown in FIG. 12. The ends 68 are complementary with respect to the exterior shape of the rail members, as shown in FIG. 12.

Figure 11:
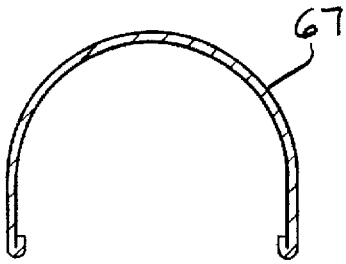
FIG. 11 is a cross-sectional view taken along the line 11—11 of FIG. 1 and shown on an enlarged scale.
Figure 12:
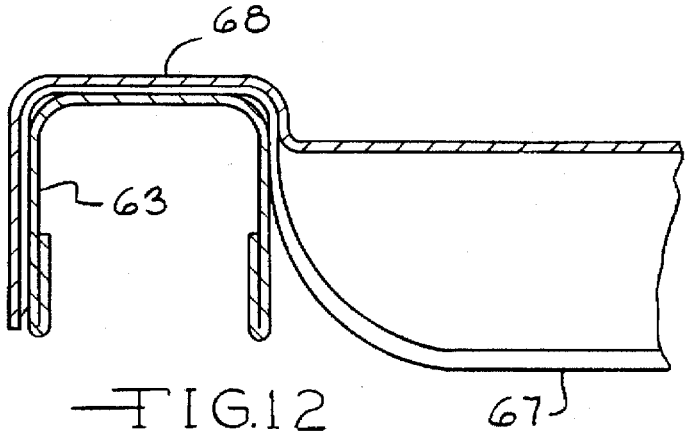
FIG. 12 is a cross-sectional view taken along the line 12—12 of FIG. 1 and shown on an enlarged scale.

Referring to FIGS. 11 and 12, the cross-members 67 are also preferably made of sheet metal and the rail member 63 and the other rail members 50–53 and 64 are made of sheet metal having inturned ends and a configuration similar to the previously described configuration of the vertical frame members 31.

Figure 13:
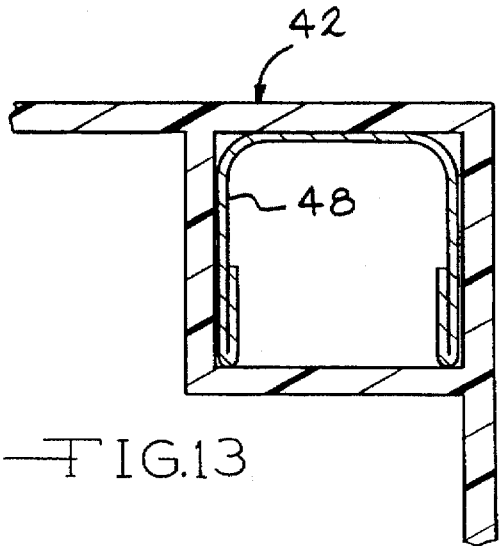
FIG. 13 is a cross-sectional view taken along the line 13—13 of FIG. 1 and shown on an enlarged scale.
Figure 14:
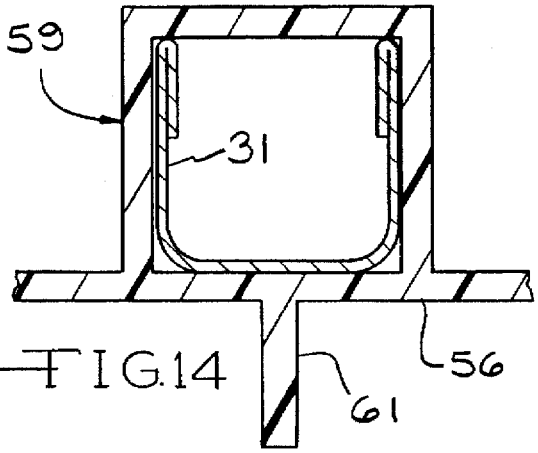
FIG. 14 is a cross-sectional view taken along the line 14—14 of FIG. 1 and shown on an enlarged scale.

Referring to FIG. 13, the upper end member 48 and its opposed upper end member 47 is also constructed of sheet metal having inturned ends and a configuration similar to that of the rail members 50–53 and 63–64 and also the configuration of the vertical members 31, previously discussed.

It has been found that the combination of the gussets together with the sheet metal framing members form a container frame assembly 20 which is relatively lightweight but still has the strength to withstand the loads received while items are in storage or in transit. Furthermore, the container frame assembly 20, according to the present invention may be dismantled and removed from the site after shipment. The container frame assembly 20 may be returned for reuse.

After the container frame assembly 20 has been positioned on the base 21, as shown in FIG. 1, the item to be shipped, such as the lawn mower 22 is positioned on the base and the outer shell, such as the cardboard carton 23 positioned adjacent the container frame 20.

Many revisions may be made to the above described preferred embodiment without departing from the scope of the present invention or from the following claims.

I claim:

1. A container frame for use with a base and a container shell, said container frame assembly comprising a reinforcing frame having a plurality of vertical members, a plurality of base corner gusset members for receiving selected ones of said vertical members, at least two longitudinal rail members extending between said vertical members, upper corner gusset members including sockets aligned ninety degrees from one another for receiving one of said rail members and one of said vertical members, upper end members extending between opposed ones of said upper corner gusset members, and a plurality of cross members extending between adjacent ones of said longitudinal rail members; said vertical members, said rail members and said end members being generally U-shaped and constructed of formed sheet metal, said U-shaped members having inturned edges.

2. A container frame, according to claim 1, wherein said corner gusset members are constructed of plastic.

3. A container frame, according to claim 1, said base gusset members including mounting members for positioning on the base and a socket for receiving one of said plurality of vertical frame members.

4. A container frame, according to claim 3, wherein said base gusset members are constructed of plastic.

5. A container frame, according to claim 1, including a plurality of center gusset members having a pair of aligned sockets for receiving aligned rail members and a perpendicular socket for receiving an upper end of one of said vertical members.

6. A container frame, according to claim 5, wherein said center gusset members are constructed of plastic.

* * * * *